US006425352B2

(12) United States Patent
Perrone

(10) Patent No.: US 6,425,352 B2
(45) Date of Patent: Jul. 30, 2002

(54) SOOTBLOWING OPTIMIZATION SYSTEM

(76) Inventor: Paul E. Perrone, 2029 Longwood Rd., Lynchburg, VA (US) 24503

( * ) Notice: Subject to any disclaimer, the term of this patent is extended or adjusted under 35 U.S.C. 154(b) by 0 days.

(21) Appl. No.: 09/920,697

(22) Filed: Aug. 1, 2001

Related U.S. Application Data

(62) Division of application No. 09/436,944, filed on Nov. 9, 1999, now Pat. No. 6,325,025.

(51) Int. Cl.[7] ..... F22B 37/48

(52) U.S. Cl. ..... 122/379; 122/390; 122/392; 15/316.1

(58) Field of Search ..... 122/379, 390, 122/392; 15/316.1

(56) References Cited

U.S. PATENT DOCUMENTS 4,408,568 A 10/1983 Wynnyckyj et al.
4,454,840 A 6/1984 Dziubakowski
4,466,383 A 8/1984 Klatt et al.
4,475,482 A 10/1984 Moss et al.
4,488,516 A 12/1984 Bueters et al.
4,552,098 A 11/1985 Wynnyckyj et al.
4,718,376 A 1/1988 Leroueil et al.
4,722,610 A 2/1988 Levert et al.
4,996,951 A 3/1991 Archer et al.
5,181,482 A 1/1993 Labbe et al.

*Primary Examiner*—Jiping Lu
(74) *Attorney, Agent, or Firm*—MacCord Mason PLLC

(57) ABSTRACT

Removal of combustion deposits from a fossil fuel boiler surface is optimized by using a sootblower to direct a cleaning medium in accordance with adjustable operating parameters against a surface of the boiler to remove accumulated deposits. Following the sootblowing operation, a parameter indicative of the extent of deposits remaining on the surface is measured to determine the efficiency of the sootblowing operation with the operating parameters used. If deposit removal is inadequate, at least one of the sootblower operating parameters is adjusted to increase its aggressiveness. If deposit removal is acceptable, at least one of the sootblower operating parameters in adjusted to decrease its aggressiveness, thereby reducing operating costs and/or the risk of damage to boiler surfaces. Additional steps of periodically measuring deposit accumulation and initiating a subsequent sootblowing operation when the deposit accumulation reaches a predetermined level can be included.

14 Claims, 2 Drawing Sheets

SOOTBLOWING OPTIMIZATION SYSTEM

This application is a division of pending U.S. Patent application Ser. No. 09/436,944, filed Nov. 9, 1999 now U.S. Pat. No. 6,325,025.

BACKGROUND OF THE INVENTION (1) Field of the Invention

The present invention relates generally to a method and apparatus for removing combustion deposits from the surfaces of fossil fuel boilers, and in particular to a method and system to optimize sootblower operating parameters by measuring the effects of sootblowing operations, and adjusting the sootblower operating parameters used in subsequent sootblowing operations based upon the effects measured.

(2) Description of the Prior Art

The combustion of coal and other fossil fuels during the production of steam or power produces combustion deposits, i.e., slag, ash and/or soot, that accumulates on the surfaces in the boiler, decreasing boiler efficiency by reducing heat transfer. These deposits are periodically removed by directing a cleaning medium, e.g., air, steam, water or mixtures thereof, against the surfaces upon which the deposits accumulate with cleaning devices known generally in the art as sootblowers.

To completely eliminate the negative effects of combustion deposits on boiler efficiency, the boiler surfaces, and in particular the heat transfer tubes, would need to be essentially free of deposits at all times. However, the continuous cleaning that would be required to maintain this cleanliness would be prohibitively expensive. In addition, injection of the cleaning medium into the boiler reduces boiler efficiency and prematurely damages heat transfer surfaces if over cleaned. Boiler surfaces, and in particular heat transfer tubes, can also be damaged as a result of erosion by high velocity air or steam jets and/or thermal impact occurring by impinging a jet of relatively cool cleaning medium, especially air or liquid, onto a hot, clean surface. Therefore, it is equally important that these surfaces are not unnecessarily cleaned.

Sootblowers are normally operated on a time schedule based on past experience, or on measured boiler conditions, in particular the reduction of heat transfer by the heat transfer tubes. Boiler conditions may be determined by visual observation, by measuring boiler parameters, or by the use of sensors on the boiler surfaces to measure conditions indicative of the level of ash accumulation, e.g., heat transfer rate degradation. Numerous methods and apparatus have been described in the prior art for measuring boiler conditions, or for determining the optimum timing of sootblowing operations. Representative patents are:

| U.S. Pat. No. | Inventor(s) |
|---|---|
| 4,408,568 | Wynnyckyj et al. |
| 4,454,840 | Dziubakowski |
| 4,466,383 | Klatt et al. |
| 4,475,482 | Moss et al. |
| 4,488,516 | Bueters et al. |
| 4,552,098 | Wynnyckyj et al. |
| 4,718,376 | Leroueil et al. |
| 4,722,610 | Levert et al. |
| 4,996,951 | Archer et al. |
| 5,181,482 | Labbe et al. |

The cost of operation of fossil fueled boilers is highly dependent upon optimizing the boiler's heat transfer efficiency, while minimizing the cost required to operate sootblowers. Control of the timing of sootblower operations is highly important in operating boilers in a efficient manner. However, there is a continuing need for further refinements in the control of boiler operations, and in particular sootblowing, that would further improve efficiencies, and resultant operating costs.

SUMMARY OF THE INVENTION

The present invention is directed to a method and apparatus for improving the operational efficiencies of fossil fueled boilers. The invention relates especially to a method and system for adjusting one or more sootblowing operating parameters based upon the effectiveness of the immediately preceding sootblowing operation. The method and system may additionally include steps and apparatus to control the timing of sootblowing operations.

The method and system described in detail herein provides for the control of the operating frequency or timing of sootblowing operations. However, unlike prior art methods and apparatus, the present invention additionally provides for the control of the operating parameters of sootblowers or other devices used to clean deposits from boiler surfaces.

The term sootblower or sootblowing "operating parameters" as used herein means the adjustable factors controlling the manner in which a sootblower directs a fluid against a surface, including jet progression rate, rotational speed, spray pattern, fluid velocity, media cleaning pattern, and fluid pressure. Each of these "operating parameters" may be adjusted to increase or reduce its contribution to the effectiveness of the cleaning fluid on the surface, this contribution to the medium effectiveness is referred to herein as the "aggressiveness" of the parameter. That is, increasing the "aggressiveness" of a parameter will contribute to the increased effectiveness of the cleaning medium in a subsequent operation, while decreasing the aggressiveness will have the opposite effect.

The present system, like some systems described in the prior art, includes a plurality of sensors to monitor the extent of combustion deposits on boiler surfaces, and one or more sootblowers to direct a cleaning medium against the surface or surfaces being monitored. However, the present invention differs in at least two major respects.

First, prior art sensors have been used to measure the extent of deposits as the deposits accumulate on a boiler surface, and activate a sootblowing operation when the deposits accumulate to a predetermined extent. In the present invention, sensors may be used for this purpose, but are additionally and primarily used to measure the amount of deposits remaining immediately after a sootblowing operation as a means to evaluate the efficiency of the sootblowing operations.

Second. data acquired by prior art sensors has been used only to determine the time of sootblowing operations. While sensor data may be used for this purpose in the present invention, the sensor data is used primarily used to adjust the sootblowing operating parameters used during the next sootblowing operation.

More specifically, the present system is comprised of at least one sensor on a boiler surface and at least one sootblower positioned to direct a cleaning fluid against the boiler surface near the sensor location. In addition, the present system includes a processor in communication with the sensor and a sootblower controller for receiving data from the sensor and adjusting the operating parameters of the sootblower based upon the data received from the sensor.

In most boilers, a plurality of sensors and sootblowers will be used, with one or more sensors being present on a surface to be cleaned by a given sootblower. For the sake of simplicity and ease of description, the present invention will often be described in terms of a single sensor and a single sootblower. It should be understood, however, that the invention also contemplates a plurality of sensors and sootblowers.

In the practice of the method of the invention, the operating parameters, e.g., the jet progression, jet pattern, lance rotational speed, fluid velocity and fluid pressure parameters, of a given sootblower are initially set at levels based on past operations or experience. The sootblower is then operated to clean a given surface when timing, operator observation, or monitored conditions indicate that deposits have accumulated in an amount requiring cleaning of the surface.

Immediately after the sootblowing operation, the sensor is used to measure the heat transfer improvement resulting from the cleaning operation, and thereby the effectiveness of the immediately preceding operation in cleaning the surface. The acquired data is fed back to a central processor, where the data is compared against a desired cleanliness standard that is stored in the processor.

If the comparison indicates that the surface has been cleaned to less than the desired standard, the processor transmits a signal to the sootblower controller to adjust at least one of the operating parameters to provide more aggressive cleaning. On the other hand, if the cleaning standard has been achieved or exceeded, the processor transmits a signal to the controller to reduce the aggressiveness of at least one of the operating parameters during the next sootblowing operation.

For example, the processor can be programmed with a plurality of spray patterns. Depending upon the measured conditions, the processor can then instruct the controller to select one of the spray patterns. It will be understood that the processor and/or controller used for this purpose may be part of, or separate from, other processing or controller components, or the sootblower.

This sequence is repeated at the end of each sootblowing operation to maintain the required level of heat transfer surface cleanliness for the current boiler operating conditions that result from operating load and fuel quality. This set of conditions is constantly changing so a prescriptive approach is inadequate. The optimum operating parameters will vary depending upon the construction of a given boiler, and upon the conditions under which the given boiler is operated. These boiler operation conditions include such factors as fuel/air mixtures, feed rates, the type of fuel used, etc.

In order to minimize the difference between the initial operating parameters used at the beginning of a boiler operation, and the optimum operating parameters, the present invention also contemplates storage of a database of historical boiler operating conditions and their optimum operations parameters. This database can then be used to determine initial operating conditions likely to approximate optimum operating conditions.

That is, the operator either enters the boiler operating conditions or these conditions are automatically determined by the processor directly receiving plant operating condition data prevailing at the time of the operation to be initiated. These boiler operating conditions are compared against a database of historic boiler operating conditions to find the closest match. The optimum operating parameters for the closest match are then used as the initial operating conditions for the new operation. As a result, the need to increase or reduce the aggressiveness of the sootblower parameters is minimized, thereby further improving operating efficiencies.

Instead of individually adjusting one or more operating parameters, the present invention also contemplates the use of measured conditions to select one of a set of operating parameters from a plurality of operating parameter sets. For example, a sootblower can be programmed with a plurality of sets of operating conditions. The processor can then be programmed to select one set of conditions from this plurality of sets in response to the results measured. For example, a first set may be comprised of first parameters for the cleaning pattern, fluid velocities, and progression rates, and a second set may be comprised of different parameters for these conditions. The processor can then select the first or second, or other set depending upon the conditions measured.

The timing of sootblowing operations in the present method can be based upon one or more techniques used in the prior art. That is, the timing can be based upon a predetermined time sequence, upon operator observation of conditions, or upon the use of sensors to measure parameters indicative of the amount or extent of deposit accumulation. The sensors of the present invention may be additionally used for this latter purpose.

That is, the present sensors are first used to measure a parameter indicative of the amount of residual deposits. These measurements are then used to calculate the quantity of residual deposits immediately after a sootblowing operation, and thereby acquire data for use in adjusting operating parameters. The same or other sensors are then used to periodically measure a variable indicative of the level of deposit accumulation and transmit collected data to the processor, where the data is compared with stored information indicating when a sootblowing operation should be initiated. When the data comparison indicates that sootblowing is required, the processor transmits a signal to the sootblower controller to begin a sootblowing operation. At the end of the sootblowing operation, the sensors are again used to determine residual deposit amounts and thereby the efficiency of the just completed sootblowing operation.

Instead of using a single sensor to perform both of the data acquisition functions, it will be obvious to one skilled in the art that separate sensors of the same or different construction, may be used. That is, one sensor can acquire data relating to deposit residues, and a second sensor can be used to acquire data relating to deposit accumulations between sootblowing operations. Both sensors may be in communication with the same processor, and through the processor to a given sootblower.

Various sensors previously described in the prior art for monitoring deposit accumulation on the surfaces of fossil fuel boilers may be used in the practice of the present invention. Preferably, the sensors measure changes in heat flux. An example of these sensors are manufactured by Boiler Management Systems, Sheffield, England, and distributed by Applied Synergistics, Inc., Lynchburg, Va. These sensors have been used prior to the present invention only to determine deposit accumulation in relation to the timing of sootblowing operations.

Various sootblowers and other cleaning devices described in the prior art for use in removing deposit accumulations from the surfaces of fossil fuel boilers can be used in the present invention. A preferred sootblower is the WLB 30 water cannon manufactured by Clyde Bergemann, Atlanta, Ga. Another sootblower particularly suited for use in the present invention is the Precision Clean sootblower manufactured by Diamond Power Specialty Company, New Orleans, La. However, the invention is also useful with standard sootblowers offered by these and other companies.

The processor used in the invention is a computer with data storage capacity and software written to perform the manipulations and calculations described herein. The exact software program is not a critical feature of the invention, and one skilled in the art will be able to write various programs to perform these functions upon being advised of the desirability of the various steps involved. The processor may also include a monitor, data storage devices, and other components common to information processors. An operator station or console with a keyboard for input to the processor and/or controller may also be included. A printer may also be provided for printing of hard copies of data. The monitor or monitors, the processor, the controller, the operator station. the printer, and the sootblower or sootblowers are in communication with each other through hard wiring, or other connectors known to one skilled in the art.

Accordingly, one aspect of the present invention is to provide a system for optimizing the removal of combustion deposits from a fossil fuel boiler surface comprising a sootblower to direct a cleaning medium against the surface using adjustable operating parameters; a sensor to determine the extent of residual deposits; a processor to compare measured data against a desired standard for cleanliness, and a sootblower controller to adjust at least one of the sootblower operating parameters.

Another aspect of the present invention is to provide a fossil fuel boiler including the above system.

Still another aspect of the present invention is to provide a method for optimizing the removal of combustion deposits from a fossil fuel boiler surface comprising the steps of directing a cleaning medium in accordance with adjustable operating parameters against a boiler surface to remove combustion deposits; acquiring data relating to residual deposits on the surface; comparing acquired data against a predetermined standard indicating a level of acceptable cleaning; and adjusting at least one of the operating parameters based upon the results of the comparison.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
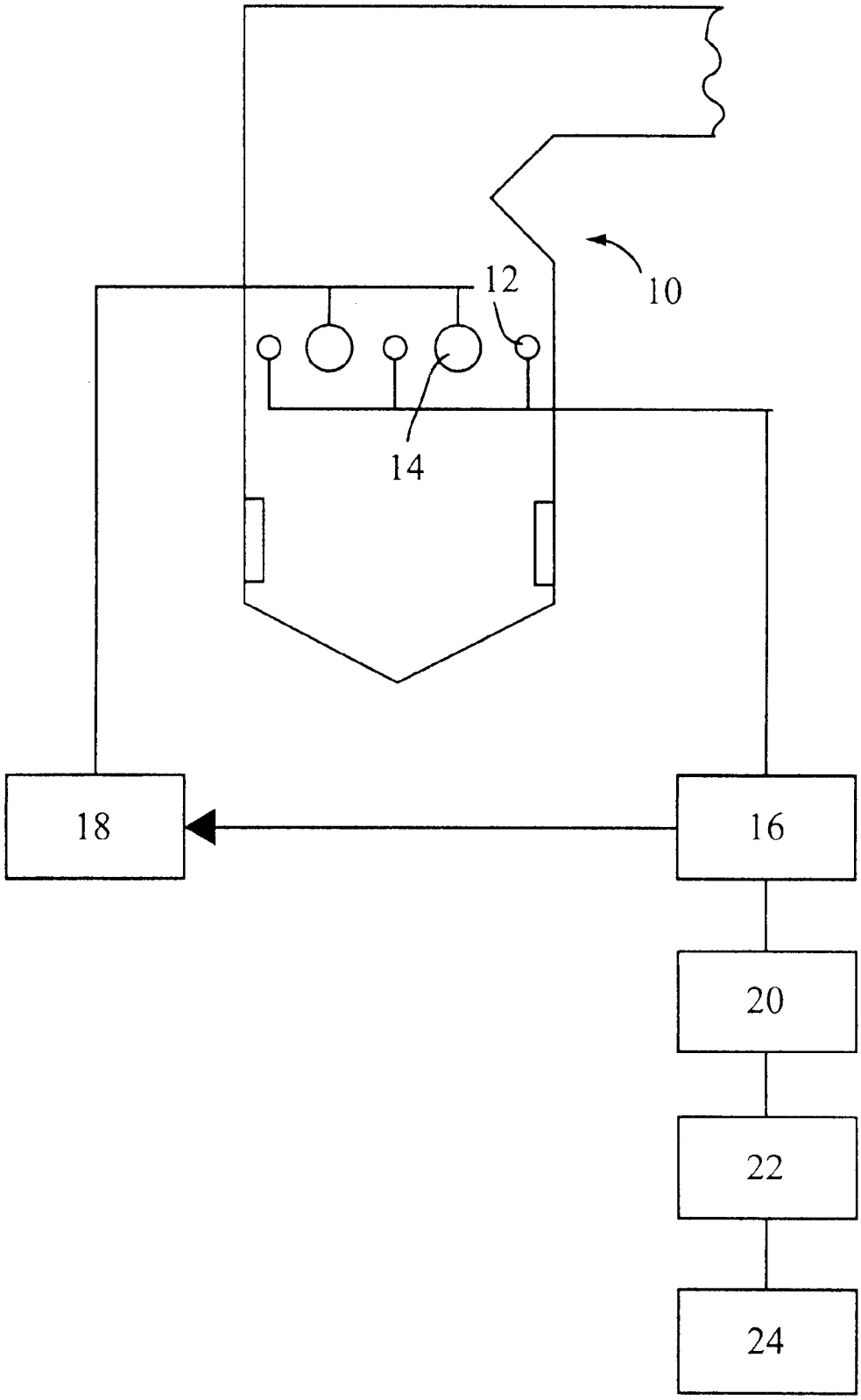
FIG. 1 is a schematic illustration of a fossil fuel boiler with sootblowers and sensors connected in accordance with the present invention.

As illustrated in FIG. 1, combustion deposits are cleaned from the surfaces of a fossil fueled boiler, generally 10, by positioning a plurality of sootblowers 14 in position to direct a cleaning medium against the surfaces. A plurality of sensors 12 may also be positioned adjacent to surfaces to be cleaned to measure conditions indicative of cleanliness, effectiveness, and/or state of cleanliness. It will be understood that FIG. 1 is for the purposes of illustration only, and that the exact location of sootblowers 14 and sensors 12 will depend upon the design of the boiler and the type of sootblowers to be used. Generally, sootblowers 14 will be positioned to direct a cleaning medium against the surface where one or more sensors 12 are positioned.

Data indicative of combustion deposit accumulation is transmitted to processor 16 by sensors 12, which are preferably heat flux sensors. Data acquired immediately after a sootblowing operation is used to determine if a desired level of cleaning was achieved by the immediately preceding sootblowing operation. If not, processor 16 instructs sootblower controller 18 to increase the aggressiveness of at least one of the sootblower operating parameters.

If a desired level of cleaning has been achieved, processor 16 instructs sootblower controller 18 to decrease the aggressiveness of at least one of the sootblower operating parameters. Depending on the instructions received, controller 18, transmits appropriate instructions to the relevant sootblower 14. This procedure is repeated at the end of each sootblowing operation for each of sootblowers 14.

Processor 16 also stores data relating to boiler conditions and developed optimum operating conditions relating to each set of boiler conditions. This data can be accessed via an operator station 20 that is also in communication with controller 18 to adjust the initial operating parameters for sootblowers 14, based upon the optimum operating parameters determined for past comparable boiler conditions. Operator station 20 can also be used to manually override or program processor 16. The system may also include a monitor 22 for visual observation of boiler conditions, sootblower operating parameters, deposit accumulation data, etc. A printer 24 can also be included to provide hardcopies of data.

Processor 16 may also store a plurality of sets of sootblower operating conditions. In this case, processor 16 selects a given set from the plurality of sets depending upon the conditions transmitted from sensors 12.

Figure 2:
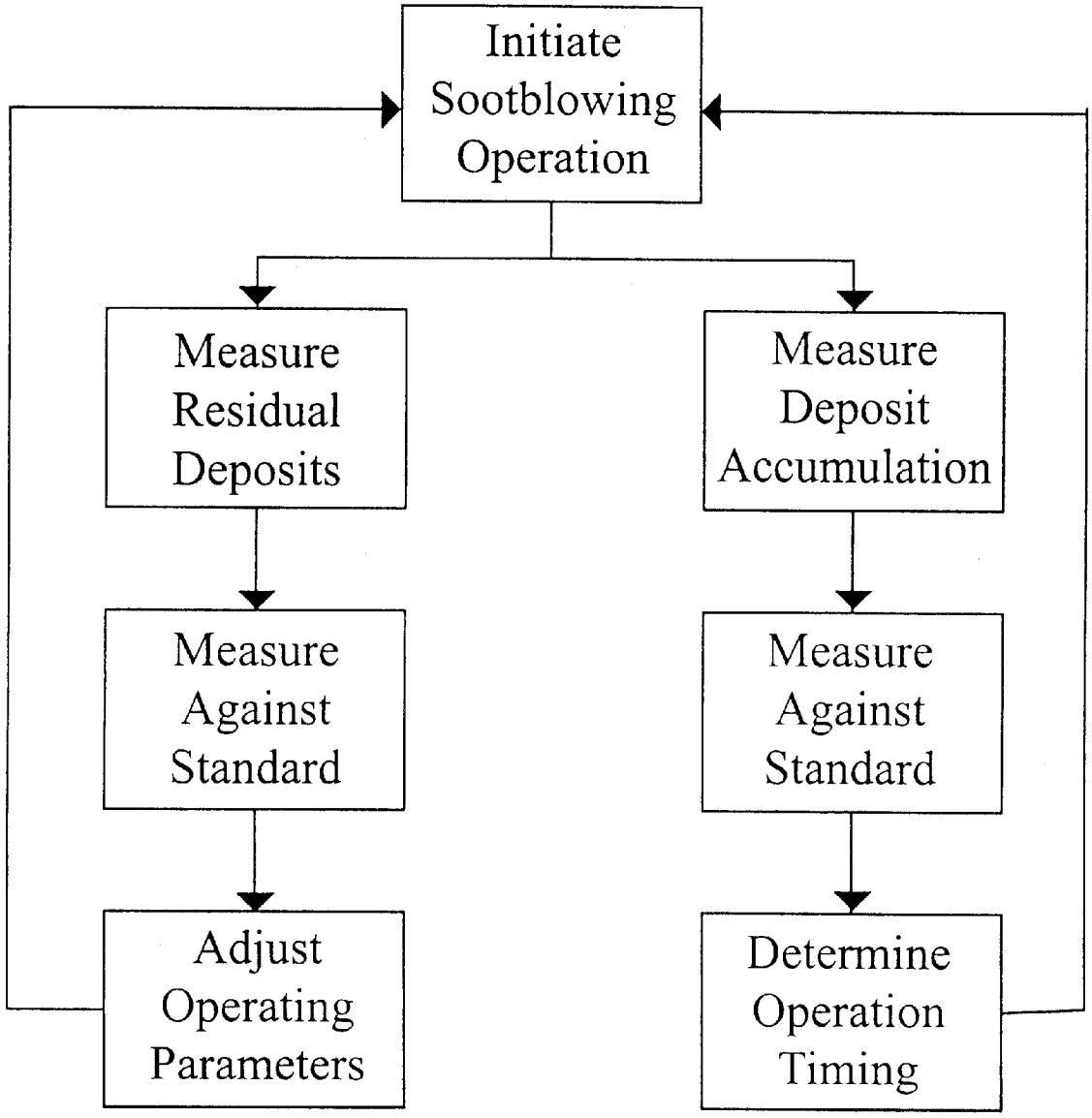
FIG. 2 is a block diagram of the steps of the present method.

The operation of the method is also shown in the block diagram of FIG. 2, beginning with the initiation of a sootblowing operation. Immediately after a given sootblowing, residual deposit data is collected and compared, using appropriate software, with stored standards defining the desired level of cleanliness or acceptable amount of residual deposits. Sootblower operating parameters may then be adjusted based upon the results for use in the next sootblowing operation.

As shown in the diagram, data indicative of deposit accumulation can also be collected periodically after a sootblowing operation and compared against a predetermined standard indicating the level at which a subsequent sootblowing is warranted. The processor can then instruct the sootblower controller to begin another operation. It will be understood that this data can be collected by the same sensors as are used to collect data relating to residual deposits, or by separate sensors.

Certain modifications and improvements will occur to those skilled in the art upon a reading of the foregoing description. It should be understood that all such modifications and improvements have been deleted herein for the sake of conciseness and readability but are properly within the scope of the follow claims.

What is claimed is:

1. A method for optimizing the removal of combustion deposits from a fossil fuel boiler surface comprising:

a) directing a cleaning medium against said surface to remove combustion deposits from said surface in accordance with an adjustable operating parameter selected from the group consisting of jet progression rate, spray pattern, cleaning pattern, cleaning medium velocity, and cleaning medium pressure;

b) acquiring data indicative of a surface condition following treatment of said surface with said cleaning medium;

c) comparing acquired data against a predetermined standard; and d) adjusting at least one of said operating parameters based upon the results of the comparison.

2. The method of claim 1, wherein the comparison indicates inadequate cleaning and the aggressiveness of said operating parameter is increased.

3. The method of claim 1, wherein the comparison indicates adequate cleaning and the aggressiveness of said operating parameter is decreased.

4. The method of claim 1, including selecting a set of operating conditions from a plurality of sets of operating conditions.

5. The method of claim 1, wherein the extent of residual deposits is determined by sensing heat flux.

6. The method of claim 1, wherein said cleaning medium is air, steam, water, or mixtures thereof.

7. A method for optimizing the removal of combustion deposits from a fossil fuel boiler surface comprising:

a) directing a cleaning medium against said surface to remove combustion deposits from said surface in accordance with an adjustable operating parameter selected from the group consisting of jet progression rate, spray pattern, cleaning pattern, cleaning medium velocity, and cleaning medium pressure;

b) acquiring data indicative of a surface condition following treatment of said surface with said cleaning medium;

c) comparing acquired data against a predetermined standard;

d) adjusting at least one of said operating parameters based upon the results of the comparison; and e) periodically measuring a parameter indicative of the extent of deposit accumulation following directing of said cleaning medium against said surface, and again directing said cleaning medium against said surface after said deposit accumulation reaches a predetermined amount.

8. The method of claim 7, wherein the comparison indicates inadequate cleaning and the aggressiveness of said operating parameter is increased.

9. The method of claim 7, wherein the comparison indicates adequate cleaning and the aggressiveness of said operating parameter is decreased.

10. The method of claim 7, including selecting a set of operating conditions from a plurality of sets of operating conditions.

11. The method of claim 7, wherein the extent of residual deposits is determined by sensing heat flux.

12. The method of claim 7, wherein said cleaning medium is air, steam, water, or mixtures thereof.

13. The method of claim 7, wherein a given sensor is used to measure both a parameter indicative of residual deposits and deposit accumulation.

14. The method of claim 7, wherein a first sensor is used to measure parameters indicative of residual deposits and a second sensor is used to measure deposit accumulation.

* * * * *